US009020178B2

(12) United States Patent
Martikainen et al.

(10) Patent No.: US 9,020,178 B2
(45) Date of Patent: Apr. 28, 2015

(54) DRIVE UNIT MOUNTING ARRANGEMENT AND LOUDSPEAKER

(75) Inventors: Ilpo Martikainen, Iisalmi (FI); Markku Kulomäki, Iisalmi (FI); Aki Mäkivirta, Iisalmi (FI); Jussi Väisänen, Iisalmi (FI); Noa Eskelinen, Iisalmi (FI); Jari Mäkinen, Iisalmi (FI); Pekka Nissinen, Iisalmi (FI)

(73) Assignee: Genelec Oy, Iisalmi (FI)

( * ) Notice: Subject to any disclaimer, the term of this patent is extended or adjusted under 35 U.S.C. 154(b) by 297 days.

(21) Appl. No.: 13/516,450

(22) PCT Filed: Dec. 17, 2009

(86) PCT No.: PCT/FI2009/051011

§ 371 (c)(1),
(2), (4) Date: Aug. 27, 2012

(87) PCT Pub. No.: WO2011/073497

PCT Pub. Date: Jun. 23, 2011

(65) Prior Publication Data

US 2012/0308063 A1 Dec. 6, 2012

(51) Int. Cl.

| | |
|---|---|
| ***H04R 1/02*** | (2006.01) |
| ***H04R 1/20*** | (2006.01) |
| ***H04R 1/06*** | (2006.01) |
| ***H04R 1/24*** | (2006.01) |
| *H04R 1/26* | (2006.01) |

(52) U.S. Cl.

CPC ..... *H04R 1/025* (2013.01); *H04R 1/06* (2013.01); *H04R 1/26* (2013.01); *H04R 2201/021* (2013.01); *H04R 1/24* (2013.01)

(58) Field of Classification Search

CPC ..... H04R 1/02; H04R 1/025; H04R 5/02
USPC ..... 381/332, 337, 353, 354
See application file for complete search history.

(56) References Cited

U.S. PATENT DOCUMENTS

| | | | | |
|---|---|---|---|---|
| 4,413,162 | A | 11/1983 | Lumsden et al. | |
| 4,552,242 | A * | 11/1985 | Kashiwabara | 181/144 |
| 4,752,963 | A | 6/1988 | Yamazaki et al. | |
| 6,665,415 | B1 * | 12/2003 | Heed | 381/410 |
| 2001/0028724 | A1 | 10/2001 | Kowaki et al. | |

(Continued)

FOREIGN PATENT DOCUMENTS

| | | |
|---|---|---|
| CN | 1307438 A | 8/2001 |
| DE | 2503828 A1 | 8/1976 |

(Continued)

OTHER PUBLICATIONS

A First Office Action for CN Appl. No. 200980162975.7 dated May 15, 2014 (w/translation).

*Primary Examiner* — Alexander Jamal
(74) *Attorney, Agent, or Firm* — Birch, Stewart, Kolasch & Birch, LLP

(57) ABSTRACT

The present invention provides a novel drive unit mounting arrangement, in which a drive unit having a chassis is mounted to a cabinet from at least two sides. The arrangement comprises a member for securing the drive unit to the cabinet from mounting points of the chassis. The arrangement further comprises a suspension member between the mounting points of the chassis and the cabinet such as to suspend the drive unit chassis elastically to the cabinet for allowing suspension in both forward and rearward directions.

25 Claims, 7 Drawing Sheets

(56) References Cited

U.S. PATENT DOCUMENTS

| | | | | |
|---|---|---|---|---|
| 2005/0025609 | A1 | 2/2005 | Oxford | |
| 2005/0036645 | A1 * | 2/2005 | Carver | 381/395 |
| 2005/0152572 | A1 | 7/2005 | Suzuki | |
| 2006/0147075 | A1 * | 7/2006 | Vu et al. | 381/335 |
| 2006/0153413 | A1 | 7/2006 | Nakajima et al. | |
| 2006/0237257 | A1 | 10/2006 | Sasaki et al. | |

FOREIGN PATENT DOCUMENTS

| | | | |
|---|---|---|---|
| DE | 3311666 | A1 | 10/1984 |
| DE | 41 33 412 | A1 | 3/1992 |
| EP | 1120992 | A2 | 8/2001 |
| EP | 1 775 988 | A1 | 4/2007 |
| JP | 43-12618 | | 5/1943 |
| JP | 56-63193 | U | 5/1981 |
| JP | 62-141899 | U | 9/1987 |
| JP | 2001-168552 | A | 6/2001 |
| JP | 2001-238290 | A | 8/2001 |
| JP | 2006-311388 | A | 11/2006 |
| JP | 2008-118477 | A | 5/2008 |
| JP | 5196588 | B2 | 2/2013 |
| WO | WO 2009/109228 | A1 | 9/2009 |

* cited by examiner

DRIVE UNIT MOUNTING ARRANGEMENT AND LOUDSPEAKER

FIELD OF THE INVENTION

The present invention relates to loudspeakers. In particular, the present invention relates to mounting drive units to loudspeaker enclosures.

BACKGROUND ART

In high fidelity loudspeaker design, the aim is to reproduce sound without added colonization. The loudspeaker is designed so that the diaphragms of the drivers are displaced by electromagnetic forces to create vibrations, which emulate the original sound as accurately as possible. The design principle is that only the sound producing diaphragms of the drivers vibrate while the cabinets, which enclose the drivers, are designed to absorb as much conducted vibration as possible so that only sound waves made intentionally by the driver diaphragms are communicated to the listener. The sound waves are reproduced by an oscillating diaphragm, which is driven by voice coil deviated with electromagnetic forces and which is suspended from the driver chassis by a surrounding elastic rim that allows the diaphragm to move back and forth. The driver chassis is typically connected to the loudspeaker cabinet with a flange joint, wherein a flange of the driver chassis is bolted or otherwise fixed to the outer surface of the cabinet having an opening for accommodating the rear portion of the driver. Between the surface of the cabinet and the inner surface of the driver chassis flange is typically adapted a ring for sealing the engagement.

While the object is to reproduce sound waves by vibrating only the diaphragm of the driver, some vibration is however known to conduct to the cabinet thus impairing the output of the loudspeaker. The same force that is moving the sound producing diaphragm also applies force to the rest of the driver e.g. the magnet and chassis. Because the mass of the magnet, the driver chassis and the rest of the driver is large compared to the mass of the diaphragm, the actual fluctuating movement—or vibration—of the rest of the driver is very small. Nevertheless, this incurred secondary force causes unintended vibration, which is ultimately conducted through the driver coupling onto to emanate around the mechanical structures of the loudspeaker. Problems are emphasized by the fact that mechanical structures have at least one resonance frequency, in which small vibrations are amplified by the structure itself. In fact, mechanical resonances can differ in different parts of the structure, wherein the resonance frequencies can be local. For example, the side wall of the loudspeaker can resonate on a different frequency than that of the rear wall. This is why mechanical resonance add unintentional color to the sound output in the resonance frequency. Depending on the mechanical source of the resonance, the frequency may be different in directions of sound output. Due to this problem the cabinet of the loudspeaker is designed such that the vibration traveling around the walls is gradually absorbed in the losses of the enclosure.

The vibration impairing the loudspeaker output is therefore the result of unintended excitation of the enclosure in which the driver is mounted. Excitation of the loudspeaker cabinet is, to a large extent, a well known problem. So far, improvements have been made to driver mountings to decouple the driver mechanically from the enclosure. On the other hand additional improvements have been made to the loudspeaker cabinets, which are designed to absorb as much vibrations as possible. Publication EP 0917396 discloses a method and arrangement for attenuating mechanical resonance in a loudspeaker, wherein a reactive additional mass is used for dampening enclosure excitation. The arrangement can, however, only be tuned to a specific frequency, which is efficient in said frequency, but cannot provide a universal solution to a variety of resonances in different frequencies. Conventional prior solutions utilize driver mountings featuring decoupling from the cabinet with a seal, such as a rubber mount, between the driver chassis flange and the loudspeaker cabinet. The elastic seal secures the driver chassis tightly to the cabinet while providing partial mechanical decoupling in terms of preventing the vibrations from conducting onto the cabinet.

However, known driver mountings have so far not been able to eliminate unintentional excitation of the loudspeaker cabinet to the extent, where output of the loudspeaker is not compromised by the above described recoil effect. Enclosure structures having either very thick walls or laminate walls comprising dampening material in between frame walls have been proposed, but in practice such structures complicated and expensive. Solutions featuring reactive dampeners and other sprung mass constructions provided between the drive unit and the enclosure, on the other hand, only attenuate vibrations in a single frequency.

AIM OF THE INVENTION

It is an aim of the present invention is to provide an improved drive unit mounting arrangement and to solve at least some of the aforementioned problems of the prior art. A further aim of the invention is to eliminate the source of the excitation of the loudspeaker cabinet caused by either acoustical source from the internal sound field or mechanical source from the reaction force on the driver magnet system, or both of them. Furthermore, it is desirable to prevent vibrations of the drive unit chassis from advancing onto the loudspeaker cabinet.

SUMMARY

The invention is based on the concept of a novel drive unit mounting arrangement, in which a drive unit having a chassis is mounted to a cabinet from at least two sides. The novel mounting arrangement comprises means for securing the drive unit to the cabinet from mounting points of the chassis. The arrangement further comprises suspension means, which are adapted between the mounting points of the chassis and the cabinet such as to suspend the drive unit chassis elastically to the cabinet for allowing suspension in both forward and rearward directions.

More specifically, the drive unit mounting arrangement according to the invention is characterized by a suspension means for suspending the drive unit chassis elastically to the cabinet to allow suspension both forward and rearward.

According to one embodiment of the invention, the cabinet comprises a drive unit enclosure embedded in an opening therein, wherein the drive unit enclosure further comprises a housing. The housing has an inner profile for accommodating the chassis of the drive unit, a first end in connection with the opening and a second end opposite to the first end. The housing also has a back plate, which is adapted to close the second end of the housing, whereby the drive unit is mounted to the cabinet via the drive unit enclosure.

According to a further embodiment of the invention, the suspension means comprises at least one axial damper, which is adapted between the drive unit chassis and the back plate of the drive unit enclosure. The suspension means also comprise at least one axial damper, which is between the drive unit chassis and the inner face of the adjacent outer zone of the opening of the cabinet covering part of the first end of the housing. The suspension means further comprise at least one radial damper, which is adapted between the drive unit chassis and the drive unit enclosure for providing also radial suspension.

According to yet another embodiment, the drive unit is cylindrical and at least one radial damper is an O-ring and at least one axial damper is circular a rubber ring.

According to a second aspect of the invention, a loudspeaker is provided comprising a cabinet, which has an opening therein. The loudspeaker also comprises at least one drive unit, which is essentially embedded in the opening, as well as suspension means for providing engagement and axial suspension between the drive unit and the cabinet. According to said second aspect of the invention, the at least one drive unit is mounted to the cabinet by means of a drive unit mounting arrangement according to claim 1.

Considerable advantages are gained with the aid of the present invention. Because the drive units are mounted to the cabinet with the inventive vibration decoupling arrangement, cabinet excitation is radically reduced, which leads to less coloration in the sound output of the loudspeaker. To be precise, the invention provides an enclosure excitation attenuating structure capable of dampening vibration on a broad frequency band. As unintended vibration energy is converted into heat by the suspension means, less effort is required to the design of dampening characteristics of the cabinet.

Respectively, the same vibration decoupling prevents external vibrating disturbances from affecting the drive unit.

In embodiments where the cabinet is provided with a dedicated drive unit enclosure or a plurality thereof, the rigidity of the cabinet is improved, because the enclosure strengthens otherwise toughened openings. Furthermore in multi drive unit applications, one or more drive units can be fully enclosed from within the cabinet so that pressure produced by the motion of other drivers, such as the bass driver, cannot influence the enclosed driver. In conventional loudspeakers, the oscillating movement of the diaphragm of the other driver, e.g. the bass driver, creates a back pressure within the cabinet, which influences the other drivers, whose rear side is exposed to said pressure fluctuation. The embodiment enjoys the benefit of reduced or even eliminated risk of such an effect. As a consequential benefit, the other (bass) drive unit can be designed regardless of said influence. The ventilation of the diaphragm and voice coil former can thus be designed uncompromised, whereby pressure build-up under the diaphragm is avoided improving the performance of the other driver, preferably a bass driver, as well. In addition, the embodiment featuring a drive unit enclosure within the cabinet is also very advantageous to manufacture.

Furthermore, the novel drive unit enclosure concept enables a simple and inexpensive construction in terms of manufacture. Regardless of the precision of the manufacturing technique, the structure is automatically made self-centering, whereby the use of precise tolerances is avoided. This is especially advantageous in assembling the device resulting in fewer manufacturing defects compared to conventional solutions. Dedicated drive unit enclosures also benefit employing coaxial elements. According to one embodiment of the invention, the number of lead-ins of Litz wires can be reduced as the wires can be terminated into a single connector of a two-way drive unit chassis. The embodiment has a further advantage of improving the ventilation of the mid range driver voice coil.

While providing excellent decoupling from the cabinet in terms of vibration conduction, the surrounding suspension arrangement of the invention makes it possible to adjust the rigidity of the suspension in different directions. This can be achieved simply by selecting appropriate materials for different directions of elasticity. With embodiments featuring drive unit enclosures, it is also possible to influence magnetic stray fields by selecting appropriate materials for the drive unit enclosure. In addition, because the drive unit is mounted to the cabinet from the inside of the cabinet, large drive unit flanges are avoided thus reducing the outer dimensions of the drive units.

BRIEF DESCRIPTION OF DRAWINGS

In the following, certain preferred embodiments of the invention are described with reference to the accompanying drawings, in which.

DESCRIPTION OF EXAMPLARY EMBODIMENTS

Figure 1:
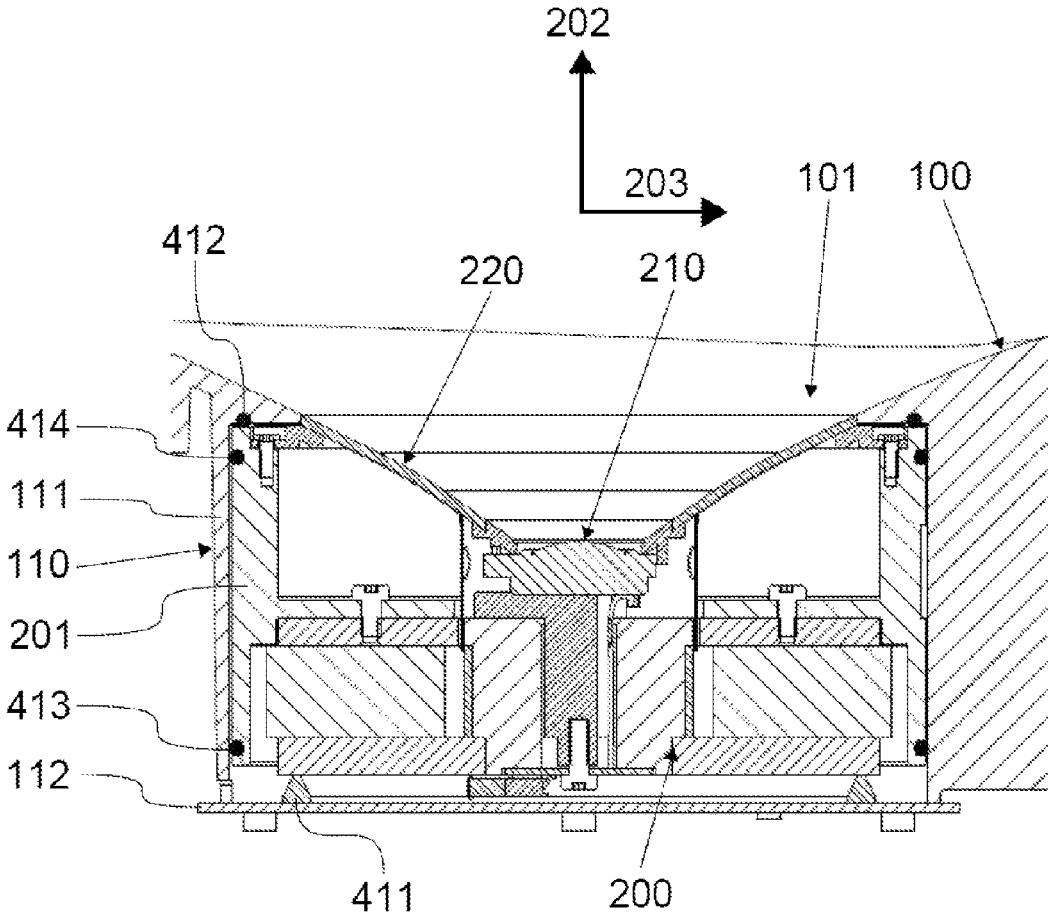
FIG. 1 presents a detailed cross section view of a drive unit mounting arrangement according to one embodiment of the invention.

As illustrated in FIG. 1, a first drive unit 200 is arranged to a cabinet 100 by applying a novel surrounding elastic suspension mounting. The cabinet 100 can, in principle, have unlimited variation in material, shape and size. However, subjects of particular interest are loudspeaker cabinets as well as in-wall, i.e. flush mounted loudspeakers. According to a one embodiment, the cabinet 100 is a loudspeaker cabinet made of molded material, most preferably pressure cast aluminum compound.

The cabinet 100 is provided with at least one opening 101; 102, in which a drive unit 200, 300 is essentially embedded. In this context essentially embedded means that the points, from which the drive unit 200, 300 is mounted into the cabinet 100 are inside the outer surface of the cabinet 100. In other words, the diaphragm of an essentially embedded drive unit, for example, can be outside the surface of the cabinet 100. According to one embodiment illustrated in FIGS. 2 and 4, a loudspeaker cabinet 100 is provided with a first opening 101 for accommodating the mounting of first a drive unit 200 and with a second opening 102 for accommodating the mounting of a second drive unit 300. Embedded to the first opening 101 is a first drive unit enclosure 110 adapted to enclose the first drive unit 200. Alternatively, the cabinet 100 could feature only one drive unit 200. Accordingly, the inner profile of the enclosure 110 conforms preferably to the shape of the cross-section of the drive unit 200. In FIG. 1, both the first drive unit 200 and the inner profile of the enclosure 110 share a cylindrical shape, which is most advantageous to manufacture.

Figure 3:
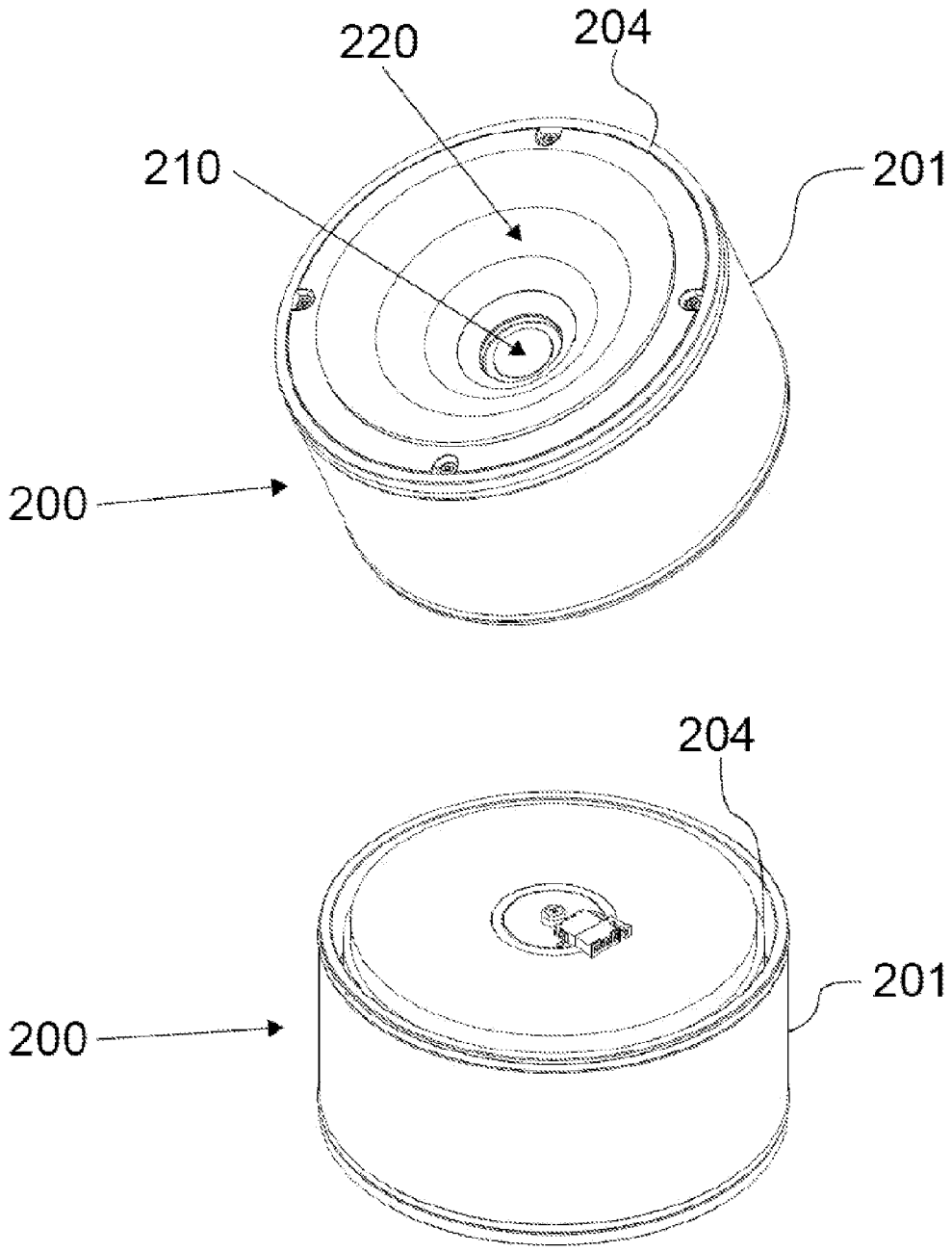
FIG. 3 presents a frontal and a rear isometric view of a first drive unit of FIGS. 1 and 2.

According to the embodiment illustrated in detail in FIG. 3, the first drive unit 200 comprises a cylindrical chassis 201, to the front end of which is adapted two drivers 210, 220 coaxially. According to the inventive concept as such, a drive unit can comprise an arbitrary number of drivers. The first drive unit 200 could naturally be constructed to comprise only one driver. According to one embodiment, however, the first drive unit 200 comprises two coaxial drivers 210, 200 and the second drive unit 300 comprises a single driver. In this context the terms front and rear refer to directions, wherein forward direction means the direction, to which sound waves primarily radiate from the speaker, i.e. the direction to which the diaphragm movement approaches the assumed sound receiver. Conversely, rearward direction refers to the opposite of forward direction. The outer driver is a mid frequency driver 220 and the inner driver is a high frequency driver 210. The structure of a coaxial drive unit arrangement is disclosed in publication WO/2009/109228 and shall be incorporated herein by reference. The drivers 210, 220 are mounted to the chassis 201 so that the acoustic axis 202 of the drivers 210, 220 and the axis of rotational symmetry of the first drive unit 200 are coaxial, which is beneficial to the design and manufacture of the cabinet 100. Since the first drive unit 200 shares its acoustic axis 202 with the drivers 210, 220, the cabinet 100 can be constructed to have the correct directivity especially in flush mounting applications. In this context, the direction of the average axis of rotational symmetry of the first drive unit 200 is referred to as the axial direction. The axial direction of a drive unit having a rotationally non-symmetrical cross-section is essentially the centre axis of the unit, preferably coaxial to the acoustic axis of the driver. Respectively, orthogonal directions in relation to the axial direction are referred to as radial directions.

The drive unit chassis 201 encloses the drivers 210, 220 and provides a founding for a modular drive unit, the mounting of which can be replicated in various applications by using only one type of a drive unit. The chassis 201 supports the inner contents of the drive unit 200 such as the magnets and the supporting structures of the drivers 210, 220. The cylindrical chassis 201 of the drive unit 200 has been provided with at least three sealing surfaces 204. As illustrated in FIG. 3, the rear and front plates of the chassis 201 has an outer annular sealing surface onto which a rear and front axial damper are adapted during mounting assembly. Likewise, the jacket of the chassis 201 is provided with grooves for accommodating radial dampers (FIG. 1). Said dampers are described in greater detail hereafter. These sealing surfaces 204 of the drive unit chassis 201 act as mounting points of the particular embodiment described herein. As is discusser later on, different drive units may feature different mounting points. Generally speaking, the points from which the drive unit is secured to the cabinet are, as a result, considered as mounting points. In conventional drive units, the mounting points would be located on the inner surface of the flange of which the drive unit is connected to the frontal surface of the cabinet.

Figure 4:
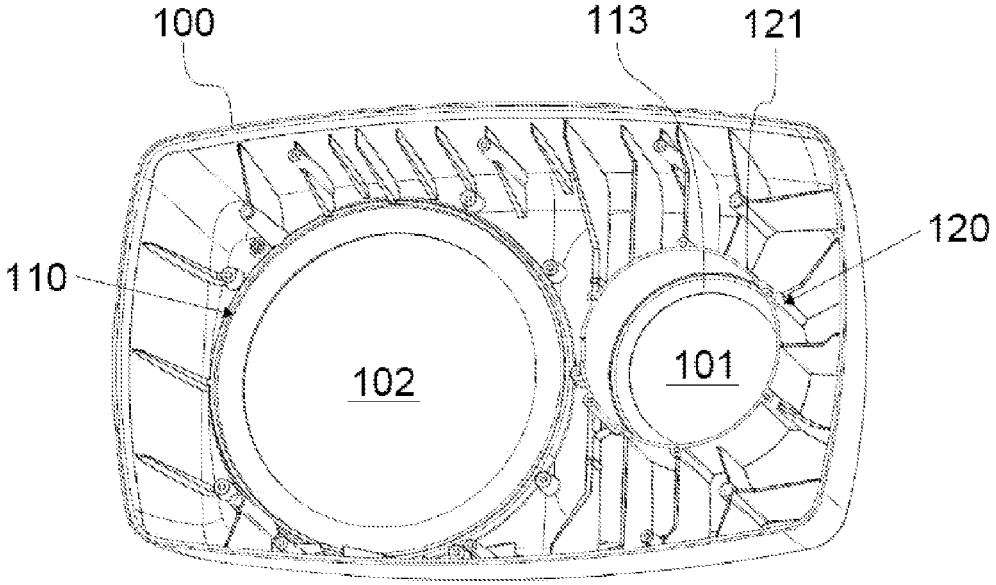
FIG. 4 presents a rear isometric view of a front half of a cabinet of a loudspeaker according to FIG. 2.

The first drive unit 200 is mounted within a first drive unit enclosure 110 embedded in said cabinet 100. The enclosure 110 can be a separate housing, but—as illustrated in FIG. 4—the enclosure 110 is made integral with the rest of the cabinet 100 structure by molding, for example. The enclosure 110 comprises a housing 111, the inner profile of which is designed to take in the drive unit 200. The enclosure 110 can therefore be considered as means for securing the drive unit 200 to the cabinet 100. As mentioned earlier, a preferable shape for the inner profile of the housing 111 is cylindrical for manufacturing reasons. A circular back plate 112 is adapted the rear end of the housing 111 for sealing the rear end of the enclosure 110. According to one aspect of the securing of the first drive unit, the means for securing the drive unit 200 to the cabinet 100 is arranged to mount the drive unit 200 outbound from the inside of the cabinet 100. Contributing to a tight engagement, the back plate 112 is provided with through holes and the rear surface of the housing 111 is provided with respective threaded apertures for accommodating a screw attachment. Said engagement is further sealed with a seal, which can be provided in tandem with the rear axial damper, which is described later on, or with a conventional circular seal, i.e. an O-ring. Respectively, the front end of the enclosure 110 is closed partially by the inner surface of the outer perimeter of the opening 101 of the cabinet 100. In other words, the front end of the enclosure 110 encircles the opening 101 inside the cabinet 100, whereby the inner surface thereof forms a flange, which forms an annular front plate 113 for the drive unit enclosure 110.

This annular front plate 113 is used to mount the front end of the drive unit 200 to the enclosure 110 and accordingly to the cabinet 100. The inner surface of the partial front plate 113 is adapted to engage with a front axial damper 412 illustrated in FIG. 1. According to one embodiment, the front axial damper 412 is a circular rubber seal, which seals the front face of the drive unit chassis 201 to the inner surface of the annular front plate 113 of the enclosure 110. The front axial damper 412 may also be provided by alternative means such as a plurality of small cylindrical axial dampers, such as coils, scattered along the space between the drive unit 200 and the annular front plate 113. Generally speaking, the axial suspension can be implemented in a variety of ways.

The front axial damper 412 forms part of the suspension means 410 between the first drive unit 200 and the cabinet 100. The first suspension means 410 is reinforced with a rear axial damper 411 adapted between the rear end of the drive unit 200 and the inner surface of the back plate 112 of the housing 110. The rear axial damper 411 is shaped so that is provides a seal between the back plate 112 and the housing 111 as well as between the back plate 112 and the drive unit 200. Such a shape is attainable by having a similar structure to that of the front axial damper 412, but with an added rear flange-like protrusion, which is shaped to seal the mating surface of the back plate 112 and the housing 111. Alternatively these two seals can be provided with separate O-rings, for example. All in all, the rear and front axial dampers 411, 412 form axial suspension means, which is adapted to suspend the drive unit chassis 201 elastically to the cabinet 100 both from rear and front of the chassis 201 for allowing suspension in both forward and rearward direction. In this context, the suspending motion is considered to occur starting from the rest position of the drive unit. In other words, known suspension arrangements provide suspension in only one direction because the return motion of a deviation does not start from the resting position of the drive unit but rather from the extreme position of the deviation.

The drive unit mounting arrangement according to the invention features elastic suspension means, which provide elastic suspension from both sides of the drive unit mounting points to an essentially rigid cabinet 100. In this context the term elastic refers to a piece being intended to yield during its conventional use. For example, the cabinet 100 is designed not to yield under normal sound reproduction circumstances and is in this context considered rigid, i.e. not elastic. In addition to the axial suspension (dampers 411, 412) described earlier, the drive unit 200 is, according to one embodiment of the invention, equipped with a rear and front radial dampers 413, 414, which form a radial part of the suspension means 410. According to one embodiment, the radial dampers 413, 414 are simple O-rings that are adapted between the inner surface of the housing 111 and respective grooves (FIG. 1) on the jacket of the drive unit chassis 201. Alternatively, radial suspension may be provided by other means such as a plurality of string pieces placed along the jacket of the drive unit chassis 201. The grooves are dimensioned so that axial play is allowed between the radial damper 413, 414 and the chassis 201. In other words, the grooves are wide enough so that the radial dampers 413, 414 are free to move within the grooves and act in the principle of a bearing. As a result, the radial dampers 413, 414 provide radial suspension as well as axial degree of freedom between the drive unit 200 and the cabinet 100.

The damping construction benefits from the equilibrium state and resonance frequencies of the different subsystems reached by adjusting the force vectors (through mass, magnetic force, current) along with using suitable isolation and mounting means. The parameters related to the dampers and mounting are defined based on the intended acoustical performance and the cabinet structure by using, for example, the Newton's second law of motion as well as the equivalent mass-spring and electro-mechanical analogy. These indicate the fact that the displacement amplitude of each sub system has a maximum at the resonance frequency. Also, the entire system, the first drive unit for example, reaches equilibrium state and remains at rest if the sum of all components of force vectors acting on it is zero. As some components of the force are frequency-dependent, a wider band damper is utilized by adjusting the elasticity and loss factors for the damper. This way, a damper, for example O-rings, and the associated mounting or housing mechanisms can be adjusted to minimize the displacement amplitude of the entire system. Thus, the mass and frequency-depended or variable excitation force and the motional velocity are eliminated by selecting an elastic damper means with suitable losses. This along with the mechanical dimensioning for the elastic attachment and the suitable mechanical design of the housing compensate the vibrations to the desirable level. Taken into the above-mentioned factors, in one embodiment of the invention, a rubber O-ring with 3 mm cross-section diameter and 144.5 mm overall diameter is advantageous in order to achieve the indented acoustical performance.

Since the first drive unit 200 is on one hand secured to the cabinet 100 and suspended in relation thereto, the drive unit 200 is on the other hand isolated from the rest of the inside of the cabinet 100 with the drive unit enclosure 110. In embodiments in which a described drive unit mounting arrangement is executed in a multi-way loudspeaker application, the isolation provides the benefit of protecting the first drive unit 200 from the pressure produced by the second drive unit motion. Without the enclosure 110, as is the case with conventional loudspeakers, the oscillating movement of the diaphragm of the second drive unit, i.e. the bass driver, creates a back pressure within the cabinet, which influences the other drivers, whose rear side is exposed to said pressure fluctuation. In other words, the movement of the first drive unit diaphragm(s) is impeded by a counter pressure front created by the second drive unit, which has a degrading effect on the performance of the first drive unit. This problem is solved with aid of the enclosure 110 described above. As a result, the second drive unit 300 can be designed independently of said effect. The ventilation of the diaphragm and voice coil former can thus be designed uncompromised, whereby pressure build-up under the diaphragm is avoided improving the performance of the second drive unit, preferably a bass driver, as well.

Figure 2:
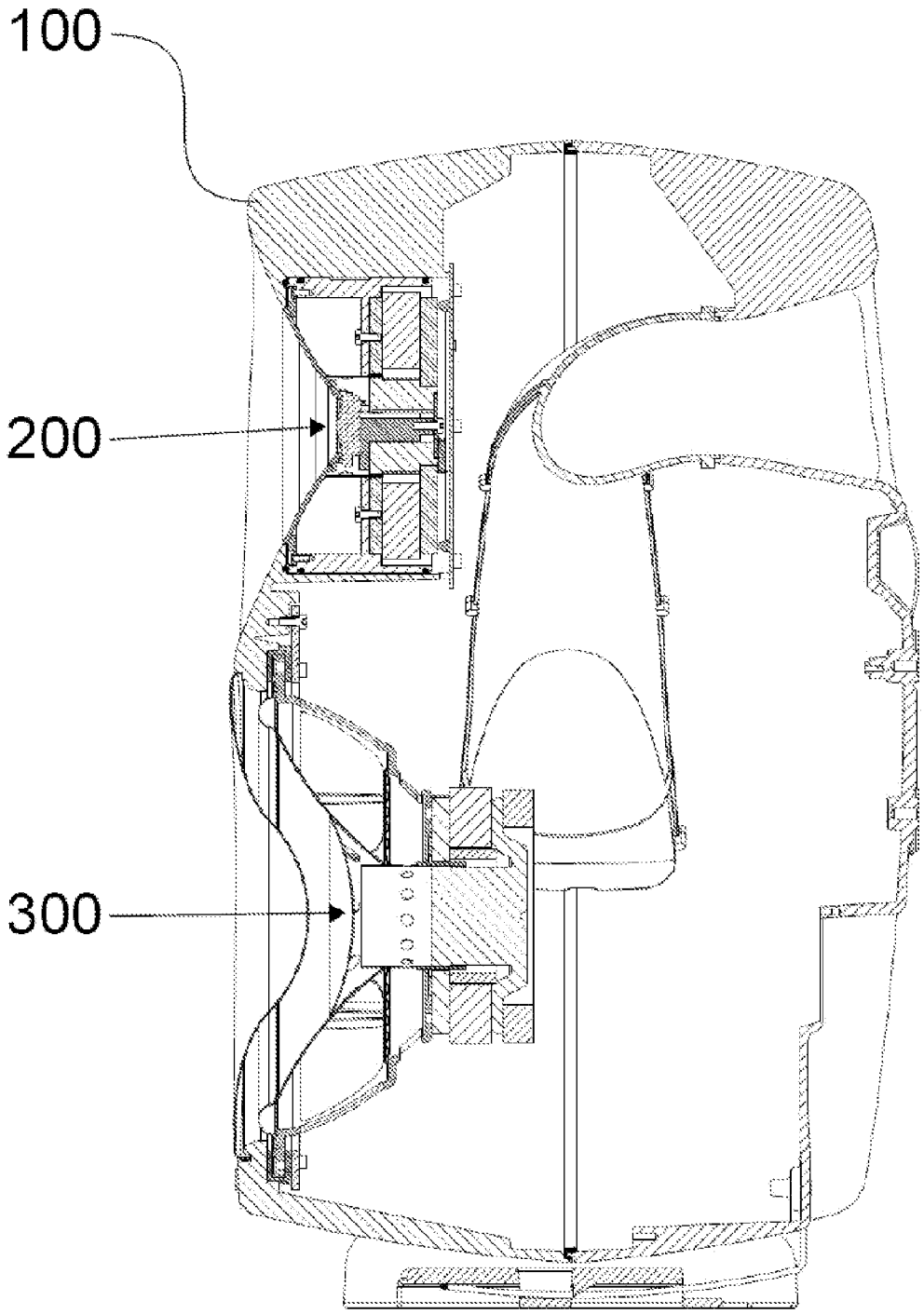
FIG. 2 presents a cross section of a loudspeaker arrangement according to one embodiment of the invention.
Figure 5:
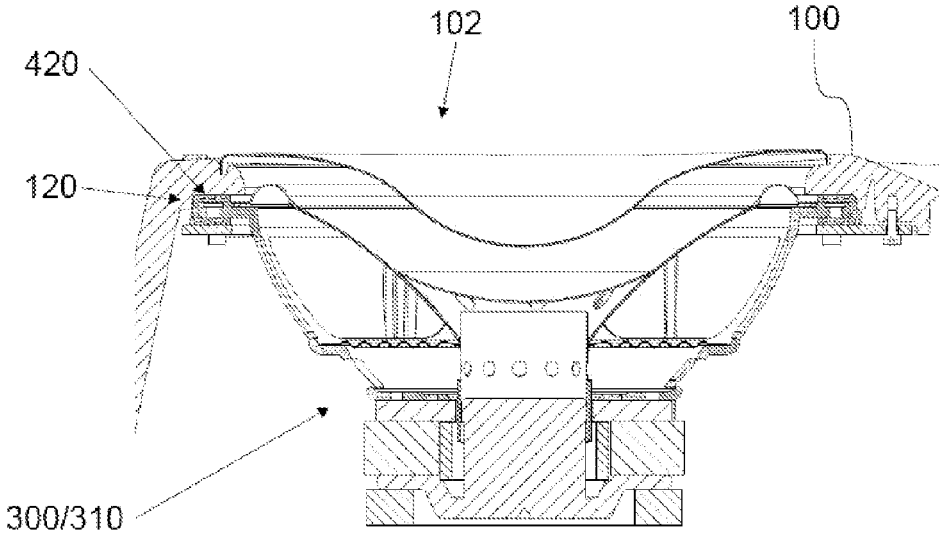
FIG. 5 presents a detailed cross-section view of low frequency drive unit mounting arrangement according to FIG. 2.

As illustrated in FIG. 2, the drive unit mounting arrangement principle is applicable also to mounting a more conventional drive unit, while decoupling it from the cabinet 100 in terms of unintended conducted vibration. According to one embodiment, the second drive unit 300 of the loudspeaker is mounted in a second drive unit enclosure 120, embedded in a second opening 102 of the cabinet. Alternatively the second opening 102 together with the second drive unit enclosure 120 could be the only mounting point in a single drive unit arrangement. Respectively, the cabinet 100 can feature more than one such mounting point in applications with a plurality of second drive units 300 as well as no, a single, or a plurality of first drive units 200. In the embodiment of FIGS. 2 and 5, however, the second drive unit 300 consists of one low frequency driver 310, whereby they share a chassis 311. According to another embodiment, the second drive unit 300 is a coaxial drive unit comprising two or more nested drivers.

Figure 6:
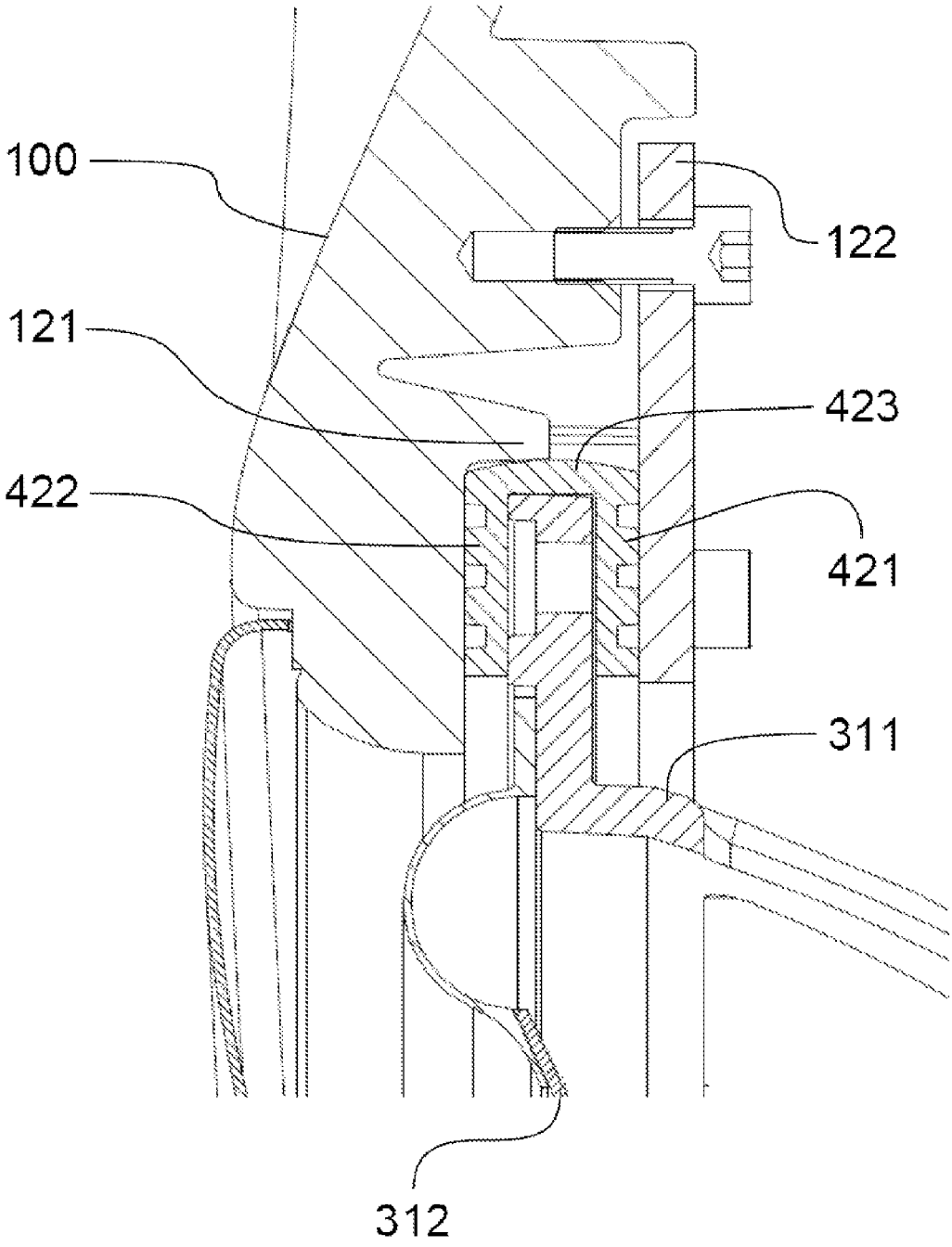
FIG. 6 presents a detailed cross-section view of the attachment arrangement of FIG. 5

As illustrated in detail in FIG. 6, the second drive unit enclosure 120 embedded to the second opening 102 of the cabinet 100 comprises a relatively narrow housing 121, which is adapted to accommodate a flange of the second drive unit chassis 311 as well as second suspension means 420. According to one embodiment, the second suspension means 420 comprises to axial dampers, which are adapted on both sides of the chassis 311, i.e. the chassis 311 is adapted between a rear axial damper 421 and a front axial damper 422. The axial dampers 421, 422 can be simple annular rubber plates, the front and rear surfaces of which are equipped with annular grooves for improved elasticity. Alternatively the axial dampers 421, 422 can be constructed from a simple suspending elastic piece, such as a rubber ring, which has an annular inner groove, in which the flange of the chassis 311 is adapted, as illustrated in FIG. 6. As can also be seen, the single rubber ring forms also a radial damper 423, which is adapted to provide elastic radial suspension between the second drive unit 300 and the cabinet. The contact points of the flange of the chassis 311 and the axial dampers are therefore the mounting points of the second driver. The axial dampers 421, 422 and the flange of the chassis 311 are supported from the front by inner surface of the outer perimeter of the second opening 102 of the cabinet. This inner surface forms a flange, which forms an annular front plate for the second drive unit enclosure 120 (see annular plate 113 of the first enclosure 110). By having a fixed integral part of the cabinet as a frontal support of the second enclosure 120, the front surface of the cabinet can be made free of discontinuities caused by screw heads, for example. The frontal support of the second drive unit enclosure could also be provided with a fixable plate.

As further illustrated in FIG. 6, the rear support of the second drive unit enclosure 120 is provided with a back plate 122 having a central aperture for parts of the second drive unit 300, such as the magnet of the low frequency driver 310 and supporting structures thereof. According to one aspect of the securing of the second drive unit 300, the means for securing the drive unit 300 to the cabinet 100 is arranged to mount the drive unit 300 outbound from the inside of the cabinet 100. The back plate 122 of the second enclosure 120 differs from the back plate 112 of the first enclosure 110 in that the back plate 122 of the second enclosure 120 does not isolate the enclosure 120 from the inside of the cabinet 100. The rear sound waves created by the diaphragm 312 of the low frequency driver 311 can therefore be directed to the inside of the cabinet 100. The sound waves do not, however, affect the performance of the first drive unit 200, because it is mounted in the isolated first drive unit enclosure 110. The engagement between the back plate 122 and the housing 121 of the second enclosure 120 can be provided similar to that of the first enclosure 110.

Figure 7:
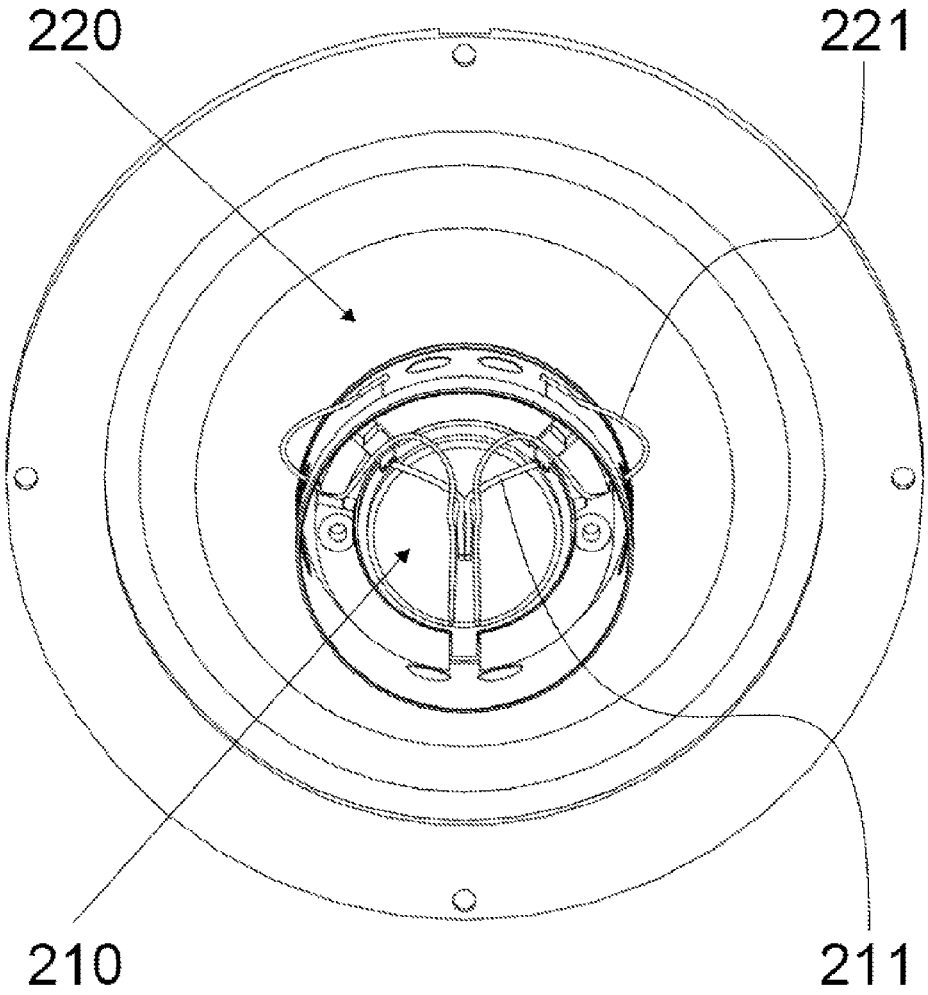
FIG. 7 presents the wiring of a drive unit of FIG. 2 in a view from below.

As said, the novel concept of mounting a drive unit can be applied to a variety of different enclosures. One embodiment is mounting to a loudspeaker enclosure, but it is also beneficial to apply the arrangement to in-wall loudspeakers. In-wall loudspeakers are typically drive units, which are embedded into a wall, wherein a recess has been provided for receiving the drive unit. In conventional in-wall loudspeakers, the drive unit is bolted to the wall from the flange with screws penetrating wall surface. The mounting can be significantly improved by applying a similar mounting arrangement as depicted in FIG. 1. In an in-wall application (not shown), a receptive recess as well as power and audio wiring are provided to the wall, wherein a drive unit, preferably a first drive unit 200 described above (FIGS. 3 and 7), is embedded. The drive unit is enclosed to the recess with an analogous front plate as illustrated in FIG. 1 having a circular aperture for exposing the drive unit. The front plate is fixed to the wall with suitable means, such as screws. The drive unit is suspended to the wall with suspension means described in greater detail above with reference to FIG. 1 and reference number 410. The axial and radial dampers both front and rear of the unit provide multi-axial suspension, whereby unintentional vibration is prevented from conducting to the wall thus creating excess resonating surfaces.

A drive unit chassis 201 presented in FIG. 1 is a particularly advantageous way of providing a compound drive unit. The chassis provides a good opportunity to arrange drive unit wiring in a simple and inexpensive way. In fact, the wiring of a drive unit 200 according to an embodiment is provided so that there is only one wiring channel and only one connector. In known structures Litz wires of each driver are wired to individual connectors on the peripheral area of the drive unit. Moreover, traditional Litz wiring is usually implemented outside the voice coil, on top of it to be precise. The wiring has traditionally been kept outside the voice coil because the wires are sensitive. As a result, they are typically retracted from the coil for precaution. In addition, conventional drivers typically feature spiders, which propose another problem for wiring the Litz wires internally within the voice coil.

Figure 8:
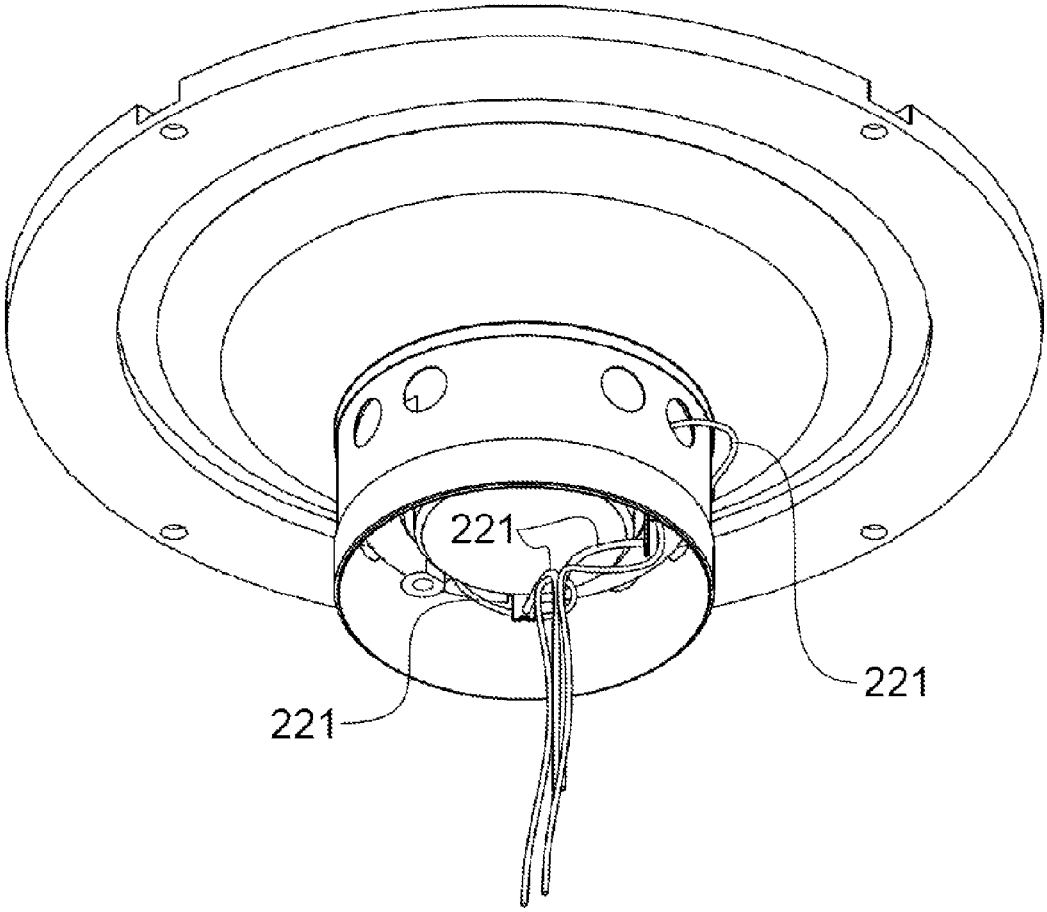
FIG. 8 presents an additional isometric view of the wiring arrangement of FIG. 7.

The simple wiring arrangement according to an embodiment is provided by arranging the Litz wires of the drivers 210, 220 to run in a groove of the inner pole piece of the outer, i.e. mid frequency driver 220 (FIG. 1). As is apparent from FIGS. 7 and 8, the Litz wires 211 of the inner diver 211, i.e. high frequency driver, are arranged straight into the groove shown in FIG. 1. The Litz wires 221 of the mid frequency driver 220 are arranged to pass through apertures provided to the voice coil former thereof. The apertures are dimensioned large enough to allow the voice coil former to deviate in a reciprocating motion during sound reproduction. The apertures also improve the ventilation of the mid range driver voice coil. The Litz wires 211 are attached to appropriate wires of the outer surface of the voice coil of the driver 220 wherefrom they advance through said apertures inside the voice coil and onto the channel (not shown in FIGS. 7 and 8). A connector has been provided to the rear face of the drive unit 200 (FIG. 3) so that the Litz wires 211, 221 of the drivers 210, 220 terminate to said connector. With aid of the single connector, the drive unit 200 can be connected very quickly to a source, which is especially advantageous in loudspeaker assembly, for example.

Accordingly, notwithstanding described problems of the prior art of the present invention, the inventive Litz wiring arrangement according to an embodiment described above and illustrated in FIGS. 7 and 8 provides a solution to the problem of wiring up Litz wires to drive units in an advantageous way. In fact, the described Litz wiring arrangement is applicable also to a variety of other drive units as well. Based on the described embodiment, it is therefore possible to provide a novel Litz wiring arrangement to a drive unit comprising at least one driver, which has a voice coil formed on a tubular voice coil former. At least one Litz wire but preferably two Litz wires are connected to the voice coil outside the voice coil former. The voice coil former comprises at least one hole, through which the Litz wires are arranged, wherein the Litz wires run from the voice coil outside the former thereof to inside the voice coil former. The wires can be run inside the voice coil former to a connector at the rear of the drive unit, for example. According to one embodiment, the Litz wires run in a groove of the inner pole piece of the driver. The voice coil former comprises at least two holes for the at least two Litz wires.

According to a further embodiment, the drive unit is a coaxial drive unit comprising two coaxially arranged drivers. The Litz wires of the inside driver are arranged conventionally and the Litz wires of the outside driver are arranged as described above. Due to the holes of the voice coil former of the outside driver, the Litz wires of both drivers can run in a same channel and terminate to the same connector. The connector can be a quick coupler, plug, solder joint or any other suitable way of connecting the Litz wire to the feeding wire.

List of reference numbers

| No | Part |
|---|---|
| 100 | loudspeaker cabinet |
| 101 | 1st opening |
| 102 | 2nd opening |
| 110 | 1st drive unit enclosure |
| 111 | housing |
| 112 | back plate |
| 113 | annular front plate |
| 120 | 2nd drive unit enclosure |
| 121 | housing |
| 122 | back plate |
| 200 | 1st drive unit |
| 201 | 1st drive unit chassis |
| 202 | acoustic axis |
| 203 | radial axis |
| 204 | sealing surface |
| 210 | high frequency driver |
| 211 | Litz wire |
| 220 | mid frequency driver |
| 221 | Litz wire |
| 300 | 2nd drive unit |
| 302 | acoustic axis |
| 303 | radial axis |
| 310 | low frequency driver |
| 311 | low frequency driver chassis |
| 312 | low frequency driver diaphragm |
| 400 | suspension means |
| 410 | 1st suspension means |
| 411 | 1st rear axial damper |
| 412 | 1st front axial damper |
| 413 | 1st rear radial damper |
| 414 | 1st front radial damper |
| 420 | 2nd suspension means |
| 421 | 2nd rear axial damper |
| 422 | 2nd front axial damper |
| 423 | 2nd radial damper |

The invention claimed is:

1. A loudspeaker comprising:

a cabinet having one or more drive unit enclosures, each of the one or more drive unit enclosures comprising a housing:

the housing including:

an inner profile, a first end, an opening at the first end, a second end opposite to the first end, and a back plate at the second end for closing the second end, and a drive unit including:

a driver, a chassis enclosing the driver and being accommodated at the inner profile of the housing, and suspension means accommodated between mounting points of the chassis and the cabinet, wherein the drive unit is embedded in the opening of the housing, and is secured to the cabinet by the mounting points of the chassis and the cabinet, and is adapted to provide engagement and axial suspension between the drive unit and the cabinet, and wherein the suspension means connects the chassis to the cabinet in an elastic manner, thereby allowing movement of drive unit in an axial direction, both toward the first end and away from the first end of the housing.

2. The loudspeaker according to claim 1, wherein the drive unit includes at least a first drive unit and a second drive unit.

3. The loudspeaker according to claim 2, wherein the first drive unit is a coaxial drive unit comprising a high-frequency driver nested within a mid-frequency driver.

4. The loudspeaker according to claim 2, wherein the second drive unit comprises at least a low-frequency driver.

5. The loudspeaker according to claim 3, wherein the second drive unit comprises at least a low-frequency driver.

6. The loudspeaker according to claim 1, wherein the suspension means is adapted to suspend the chassis axially from both a rear and a front of the chassis.

7. The loudspeaker according to claim 1, wherein means for securing the drive unit to the cabinet are adapted to mount the drive unit from an inside of the cabinet.

8. The loudspeaker according to claim 1, wherein an adjacent outer zone of the opening of the cabinet covers a part of the first end of the housing and forms an annular front plate of the drive unit enclosure.

9. The loudspeaker according to claim 8, wherein the suspension means is arranged within the drive unit enclosure.

10. The loudspeaker according to claim 1, wherein the suspension means comprises:

at least one axial damper provided at least between the chassis and the cabinet for providing axial suspension, and at least one radial damper provided between the chassis and the cabinet for providing radial suspension.

11. The loudspeaker according to claim 10, wherein at least one rear axial damper is provided between the chassis and the back plate of the enclosure.

12. The loudspeaker according to claim 10, wherein the at least one axial damper is provided between the chassis and a front plate.

13. The loudspeaker according to claim 11, wherein the at least one axial damper is provided between the chassis and a front plate.

14. The loudspeaker according to claim 10, wherein the at least one radial damper is an O-ring.

15. The loudspeaker according to claim 11, wherein the at least one radial damper is an O-ring.

16. The loudspeaker according to claim 10, wherein the at least one axial damper is circular rubber ring.

17. The loudspeaker according to claim 11, wherein the at least one axial damper is circular rubber ring.

18. The loudspeaker according to claim 1, wherein the drive unit is a coaxial drive unit comprising a high frequency driver nested within a mid-frequency driver.

19. The loudspeaker according to claim 18, wherein the chassis of the drive unit is cylindrical.

20. The loudspeaker according to claim 1, further comprising a voice coil former comprising at least two holes for two Litz wires.

21. The loudspeaker according to claim 1, wherein the drive unit is a coaxial drive unit comprising two coaxially arranged drivers, and further comprising Litz wires of both of the coaxially arranged drivers that run within a voice coil former of an outer driver and terminate at a same connector.

22. A wiring arrangement for wiring Litz wires of a drive unit comprising:

at least one driver having a voice coil formed on a tubular voice coil former, at least one connector for feeding the drive unit, at least one Litz wire connected to the voice coil outside the voice coil former and to the at least one connector, wherein the voice coil former comprises at least one hole, through which the Litz wires are arranged, to run from outside to inside the voice coil former and to the connector.

23. The wiring arrangement according to claim 20, wherein the connector is provided to the rear of the drive unit.

24. The wiring arrangement according to claim 20, wherein the voice coil former preferably comprises at least two holes for the two of the Litz wires.

25. The wiring arrangement according to claim 20, wherein the drive unit is a coaxial drive unit comprising two coaxially arranged drivers, wherein the Litz wires of both of the coaxially arranged drivers can run within the voice coil former of said outer driver and terminate at the connector.

* * * * *